US009651001B2

(12) United States Patent
Jung et al.

(10) Patent No.: US 9,651,001 B2
(45) Date of Patent: May 16, 2017

(54) EXHAUST GAS RECIRCULATION (EGR) VALVE FOR VEHICLE

(71) Applicant: KAMTEC, Inc., Chungcheongbuk-do (KR)

(72) Inventors: Ki Ho Jung, Chungcheongbuk-do (KR); Jung Suek Koo, Chungcheongbuk-do (KR); Myeong Jae Lee, Chungcheongbuk-do (KR)

(73) Assignee: KAMTEC, INC., Jincheon-Gun (KR)

( * ) Notice: Subject to any disclaimer, the term of this patent is extended or adjusted under 35 U.S.C. 154(b) by 403 days.

(21) Appl. No.: 14/492,091

(22) Filed: Sep. 22, 2014

(65) Prior Publication Data

US 2015/0107565 A1 Apr. 23, 2015

(30) Foreign Application Priority Data

Oct. 23, 2013 (KR) ..... 10-2013-0126361

(51) Int. Cl.
*F02M 25/07* (2006.01)
*F02M 26/21* (2016.01)
(Continued)

(52) U.S. Cl.
CPC ..... *F02M 25/0798* (2013.01); *F02M 26/21* (2016.02); *F02M 26/51* (2016.02);
(Continued)

(58) Field of Classification Search
CPC .... F02M 25/0798; F02M 26/54; F02M 26/58; F02M 26/69; F02M 26/21; F02M 26/64; F02M 26/70; F02M 26/71; F02M 26/51
See application file for complete search history.

(56) References Cited

U.S. PATENT DOCUMENTS 7,971,578 B2 7/2011 Lim et al.
2003/0084887 A1 * 5/2003 Veinotte ..... F02M 26/21 123/568.18
(Continued)

FOREIGN PATENT DOCUMENTS

JP 56-97530 12/1979
JP S55-87848 A 7/1980
(Continued)

OTHER PUBLICATIONS

Office Action for EP Application No. 14 188 130.0 mailed Dec. 2, 2015 from European Patent Office.
(Continued)

*Primary Examiner* — Jacob Amick
(74) *Attorney, Agent, or Firm* — Park, Kim & Suh, LLC

(57) ABSTRACT

Disclosed is an exhaust gas recirculation (EGR) valve for a vehicle which achieves regulation of the flow rate of exhaust gas introduced into an engine and the flow rate of fresh air. The EGR valve includes a fresh air flow channel, an EGR flow channel connected to the fresh air flow channel and a valve unit configured to open or close the EGR flow channel and to selectively block the fresh air flow channel according to an opened/closed state of the EGR flow channel. The valve unit includes a first valve to open or close the EGR flow channel and a second valve arranged at one side of the first valve at a different angle from an arrangement angle of the first valve. The second valve is moved along with the first valve to selectively interfere with a flow stream of fresh air in the fresh air flow channel.

18 Claims, 9 Drawing Sheets

(51) Int. Cl.

| | |
|---|---|
| ***F02M 26/64*** | (2016.01) |
| ***F02M 26/70*** | (2016.01) |
| ***F02M 26/71*** | (2016.01) |
| ***F02M 26/51*** | (2016.01) |
| *F02D 9/16* | (2006.01) |

(52) U.S. Cl.

CPC ..... *F02M 26/64* (2016.02); *F02M 26/70* (2016.02); *F02M 26/71* (2016.02); *F02D 9/16* (2013.01)

(56) References Cited

U.S. PATENT DOCUMENTS

| | | | | |
|---|---|---|---|---|
| 2009/0014674 | A1* | 1/2009 | Grissom ..... | F01D 17/145 251/298 |
| 2011/0048004 | A1 | 3/2011 | Leroux et al. | |
| 2011/0114211 | A1 | 5/2011 | Leroux et al. | |
| 2013/0025576 | A1 | 1/2013 | Busato et al. | |

FOREIGN PATENT DOCUMENTS

| | | | |
|---|---|---|---|
| JP | 56-054947 | A | 5/1981 |
| JP | S59-119054 | A | 7/1984 |
| JP | 2002-529653 | A | 9/2002 |
| JP | 2002-317658 | A | 10/2002 |
| JP | 2013-24346 | | 2/2013 |
| KR | 10-2010-0107494 | A | 10/2010 |
| KR | 10-1057067 | B1 | 8/2011 |
| WO | 2011/130015 | A2 | 10/2011 |
| WO | 2013/105135 | A1 | 7/2013 |
| WO | WO 2014/082983 | A1 | 6/2014 |

OTHER PUBLICATIONS

European search report for 14188130 mailed Dec. 10, 2013 from European Patent Office.

* cited by examiner (a)

EXHAUST GAS RECIRCULATION (EGR) VALVE FOR VEHICLE

CROSS REFERENCE TO PRIOR APPLICATIONS

This application claims priority under 35 U.S.C. §119 to Korean Patent Application No. KR 10-2013-0126361 filed on Oct. 23, 2013, which is hereby incorporated by reference in its entirety.

BACKGROUND OF THE INVENTION

Field of the Invention

The present invention relates to exhaust gas recirculation (EGR) valves for vehicles and, more particularly, to EGR valves for vehicles which may achieve easy and efficient regulation to keep a balance between the flow rate of exhaust gas to be introduced into an engine through an EGR flow channel and the flow rate of fresh air from the outside.

Description of the Related Art

Generally, in order to restrict production of nitrogen oxide (NOx) from exhaust gas discharged from engines of vehicles, the most frequently used method at present is the use of exhaust gas recirculation (EGR) valves that add some cooled exhaust gas to a mixer, causing the same to be suctioned into a cylinder.

Considering a configuration of such an EGR valve, as disclosed in Korean Patent Laid-Open Publication No. 2010-107494, the EGR valve includes a fresh air flow channel for introduction of outside fresh air and an EGR flow channel for guidance of exhaust gas discharged from an engine to allow the exhaust gas to be returned and reintroduced into the engine.

Here, the fresh air flow channel is provided with a fresh air regulation valve and the EGR flow channel is provided with an EGR regulation valve.

The EGR regulation valve and the fresh air regulation valve are linked to each other via power transmission means, such as gears, and an actuator connected to the power transmission means, rather than being separately moved.

In the aforementioned related art, when the EGR regulation valve is completely closed, the fresh air regulation valve is arranged parallel to a flow direction of fresh air. This arrangement minimizes obstruction of introduction of fresh air by the fresh air regulation valve and, in turn, allows fresh air to be introduced into the engine while maintaining the maximum flow rate thereof.

Then, when the EGR regulation valve is opened to a given degree for reintroduction of exhaust gas into the engine, the fresh air regulation valve is simultaneously moved to partially block a cross sectional area of the fresh air flow channel, thereby serving to reduce the inlet amount of fresh air per hour.

Then, when the EGR regulation valve is completely opened, the fresh air regulation valve reaches a maximum closed state thereof, thereby further reducing the amount of fresh air to be introduced into the engine.

In the related art as described above, the fresh air regulation valve and the EGR regulation valve are indirectly connected to each other via power transmission means, such as gears or cams. Damage to the power transmission means, such as gears or cams, may prevent efficient linked operation between the fresh air regulation valve and the EGR regulation valve, which may in turn causes the fresh air regulation valve or the EGR regulation valve to have difficulty in regulating the flow rate of fresh air or exhaust gas.

In addition, due to the fact that a valve plate and a valve rotating shaft are located in the fresh air flow channel, a stream of fresh air should pass the valve plate and the valve rotating shaft, which disadvantageously causes deterioration in the inlet pressure and inlet amount of fresh air even if the fresh air flow channel is opened by 100%.

SUMMARY OF THE INVENTION

Therefore, the present invention has been made in view of the problems of the related art, and it is one object of the present invention to provide an exhaust gas recirculation (EGR) valve for vehicles, which may achieve easy and efficient regulation to keep a balance between the flow rate of exhaust gas to be reintroduced and the flow rate of fresh air.

It is another object of the present invention to provide an EGR valve for vehicles in which a fresh air regulation valve installed on a fresh air flow channel is configured to selectively interfere with the fresh air flow channel such that introduced fresh air does not come into contact with the fresh air regulation valve when a required suction amount of the fresh air flow channel is increased, which may prevent deterioration in the inlet amount or inlet pressure of fresh air.

It is a further object of the present invention to provide an EGR valve for vehicles in which a valve to control a fresh air flow channel and a valve to control an EGR flow channel are connected to each other via a single rotating shaft, which may achieve more rapid and accurate regulation to keep a balance between the flow rate of fresh air and the flow rate of exhaust gas.

In accordance with one aspect of the present invention, to accomplish the above and other objects, an exhaust gas recirculation (EGR) valve for a vehicle includes a fresh air flow channel, an EGR flow channel connected to the fresh air flow channel and a valve unit configured to open or close the EGR flow channel and to selectively block a portion of the fresh air flow channel according to an opened or closed state of the EGR flow channel, wherein the valve unit includes a first valve configured to open or close the EGR flow channel and a second valve located at one side of the first valve, the second valve being arranged at a different angle from an arrangement angle of the first valve, and wherein the second valve is moved along with the first valve to selectively interfere with a flow stream of fresh air in the fresh air flow channel.

In accordance with another aspect of the present invention, an EGR valve for a vehicle includes a fresh air flow channel for flow of fresh air, an EGR flow channel configured to communicate with the fresh air flow channel, a rotating shaft located at a position deviating from the fresh air flow channel and a valve unit configured to selectively open or close the EGR flow channel by being rotated about the rotating shaft and to selectively interfere with a flow stream of fresh air in the fresh air flow channel according to an opened or closed state of the EGR flow channel so as to regulate a flow rate of fresh air.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, embodiments of the present invention will be described in detail with reference to the accompanying drawings.

Figure 1:
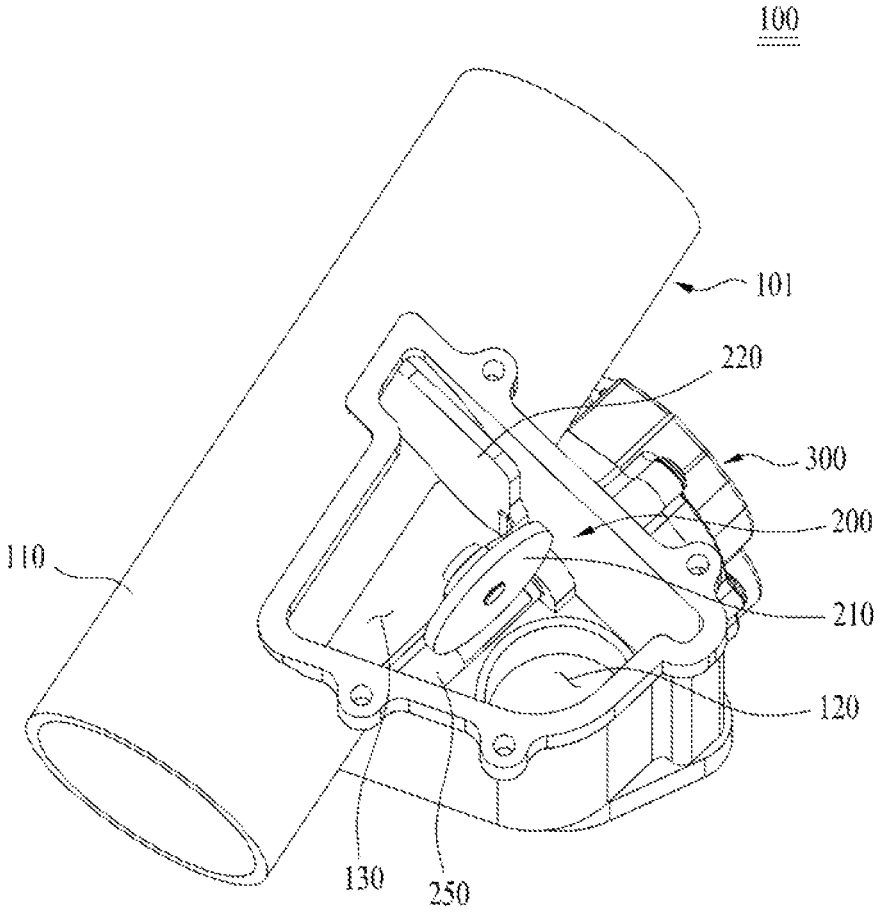
FIG. 1 is a perspective view of an EGR valve for vehicles according to the present invention.

As exemplarily shown in FIG. 1, an exhaust gas recirculation (EGR) valve according to the present invention, designated by reference numeral 100, includes a housing 101 defining an external appearance of the EGR valve 100. The housing 101 is provided with a tubular fresh air flow channel 110 through which fresh air flows, and an EGR flow channel 120 is provided next to the fresh air flow channel 110.

A guide space 130 is defined between the EGR flow channel 120 and the fresh air flow channel 110 to guide exhaust gas emerging from the EGR flow channel 120 to the fresh air flow channel 110. The guide space 130 serves as a buffer chamber.

A valve unit 200 is located in the guide space 130. The valve unit 200 serves not only to selectively open or close the EGR flow channel 120, but also to selectively interfere with an inner space of the fresh air flow channel 110 so as to regulate the inlet amount of fresh air and to control a flow stream of fresh air.

Although this will be described below in detail, the valve unit 200 includes a first valve 210 serving as an EGR regulation valve and a second valve 220 serving as a fresh air regulation valve. Specifically, the first valve 210 is configured to open or close the EGR flow channel 120 or to regulate an opening angle of the EGR flow channel 120. The second valve 220 is linked to the first valve 210 and simultaneously moved with the first valve 210. The second valve 220 is configured to selectively interfere with the fresh air flow channel 110 so as to control a flow stream of fresh air.

The first valve 210 and the second valve 220 are arranged at different orientation angles. This is because a flow stream of exhaust gas having passed through the EGR flow channel 120 and a flow stream of fresh air passing through the fresh air flow channel 110 are perpendicular to each other, or form any of various other angles.

The valve unit 200 is installed to a rotating shaft 250 and moved via rotation of the rotating shaft 250. Accordingly, there is a feature in that both the first valve 210 and the second valve 220 are simultaneously moved upon rotation of the rotating shaft 250.

The rotating shaft 250 is connected to a drive unit 300 placed at one side of the housing 101. The valve unit 200 is rotated upon receiving power provided by and transmitted from the drive unit 300, thereby serving to simultaneously regulate the inlet amount of exhaust gas introduced through the EGR flow channel 120 and the inlet amount of fresh air introduced through the fresh air flow channel 110.

Figure 2:
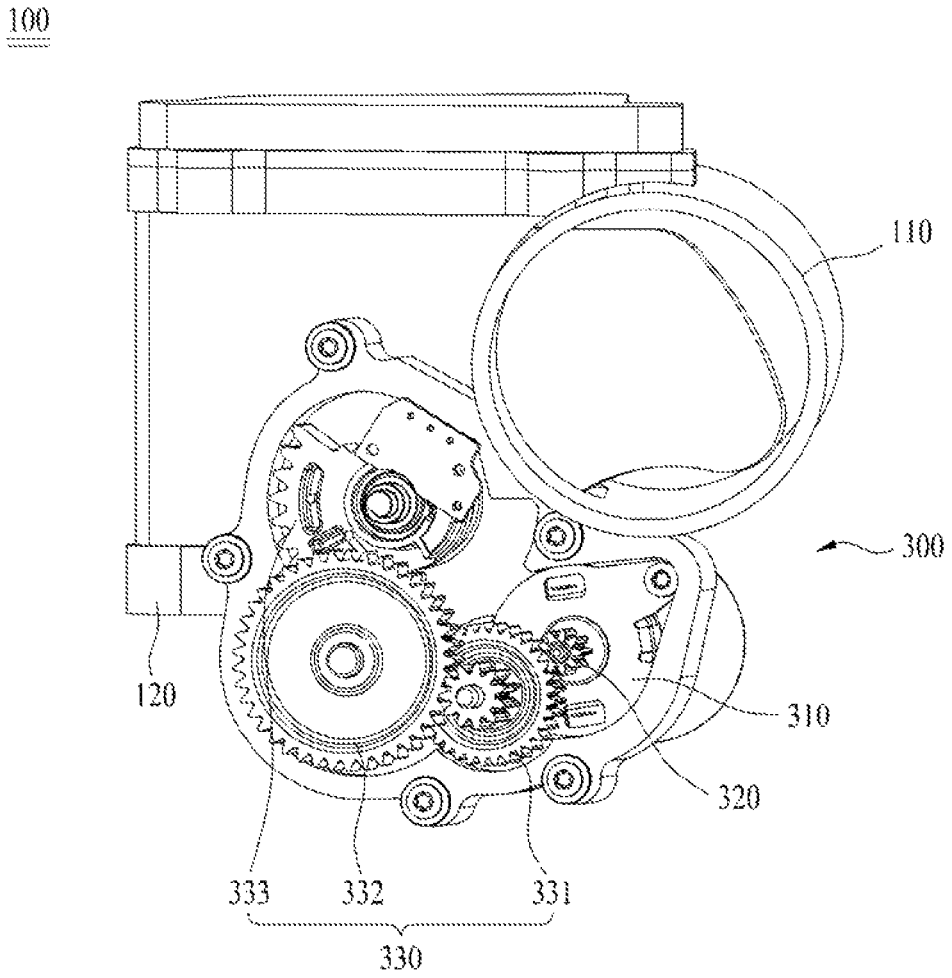
FIG. 2 is a side perspective view showing a drive unit included in the EGR valve for vehicles according to the present invention.
Figure 3:
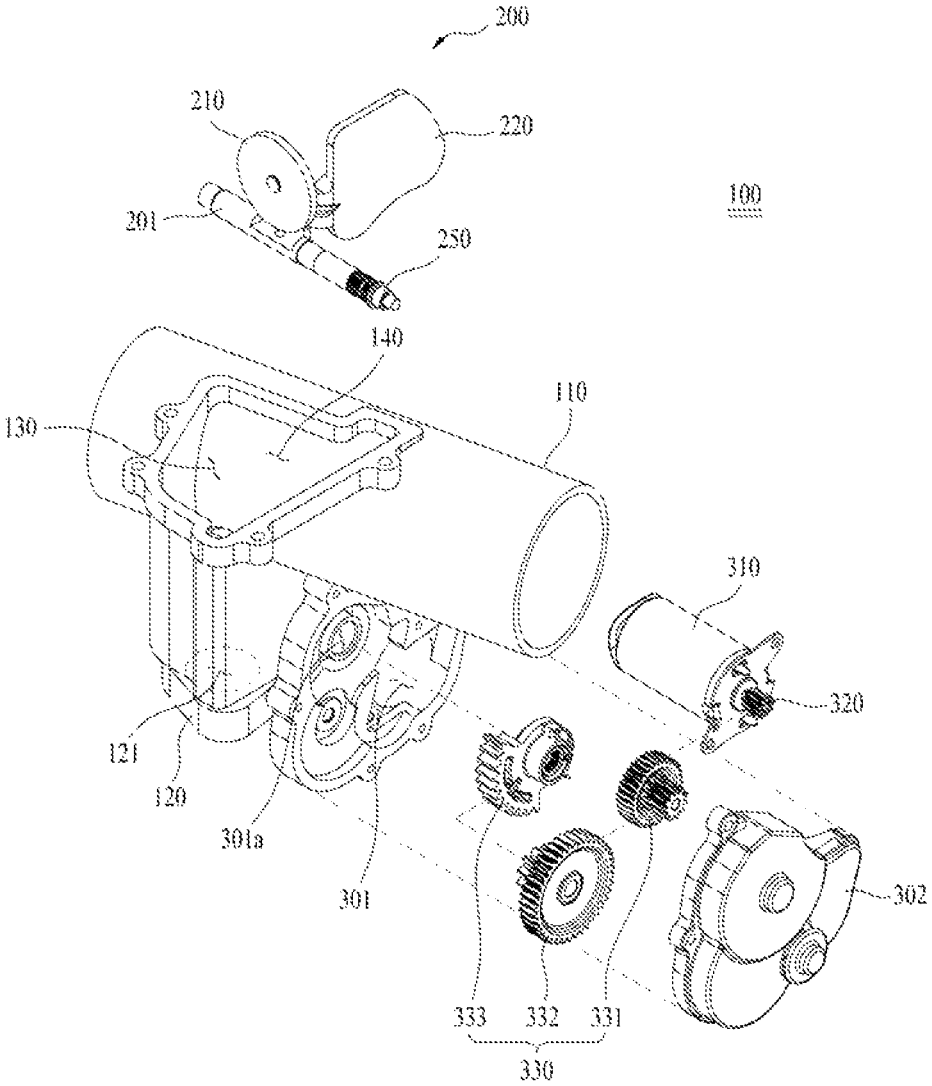
FIG. 3 is an exploded perspective view of the EGR valve for vehicles according to the present invention.

As exemplarily shown in FIGS. 2 and 3 showing a configuration of the drive unit 300, the drive unit 300 includes a motor 310, a pinion gear 320 installed to a shaft of the motor 310, and a gear module 330 interposed between the pinion gear 320 and the rotating shaft 250.

The gear module 330 includes a double-layered first gear 331 engaged with the pinion gear 320, a double-layered second gear 332 engaged with the first gear 331, and a fan-shaped third gear 333 engaged with the second gear 332, the rotating shaft 250 being fixedly inserted into the third gear 333.

In addition, the drive unit 300 further includes a drive unit cover 302 to prevent the motor 310 and the gear module 330 from being exposed outward.

The rotating shaft 250 is configured to pass through a hole 301*a* perforated in a peripheral position of a drive unit receptacle 301, in which the drive unit 300 is received, to thereby be inserted into and coupled to the valve unit 200.

In the present embodiment, although the drive unit receptacle 301 is shown as being integrally formed at the housing 101, the drive unit receptacle 301 may be separably coupled to the housing 101.

In this case, the drive unit receptacle 301 and the gear module 330 together may constitute a single module, thereby being selectively coupled to or separated from the housing 101.

The size of the motor 310 or the gear module 330 may be changed according to the kind of a vehicle to which the present invention is applied. In the case in which EGR valves for use in different kinds of vehicles are required, the housings 101 of the EGR valves may have the same size and the drive unit receptacles 301 and the gear modules 330, which are coupled to the housings 101 of the respective EGR valves, may have different sizes.

Accordingly, by providing the housing 101 with a standardized size and changing the size of a module, which includes the drive unit receptacle 301 and the gear module 330, coupled to the housing 101 to match a situation, reduction in price, easy assembly and repair/maintenance convenience may be accomplished.

The valve unit 200 includes the first valve 210 connected to the rotating shaft 250 and the second valve 220 placed next to the first valve 210.

Both the first valve 210 and the second valve 220 take the form of a plate valve.

The first valve 210 preferably has a shape (e.g., a disc shape) corresponding to a shape of an inlet port 121 of the EGR flow channel 120.

In the case of the second valve 220, this is adapted to enter a flow direction of fresh air from the lateral side so as to interfere with a flow stream of fresh air. Therefore, the second valve 220 is preferably designed in consideration of a shape of the fresh air flow channel 110.

When viewed from top, an arrangement direction of the second valve 220 may be perpendicular to a flow direction of fresh air, or may be tilted toward or away from a flow direction of fresh air.

A direction in which the first valve 210 is arranged and a direction in which the second valve 220 is arranged are preferably at a right angle, or form any of various other angles. This is because a flow direction of exhaust gas and a flow direction of fresh air differ from each other as described above.

The first valve 210 may be a pivot valve type with respect to the EGR flow channel 120, and the second valve 220 may be a slide valve type with respect to the fresh air flow channel 110.

That is, the second valve 220 may be moved in a direction perpendicular to or tilted relative to an inlet direction of fresh air, rather than being parallel to or opposite to an inlet direction of fresh air.

When it is desired to keep the second valve 220, which is pivotally rotatable in a direction parallel to or opposite to an inlet direction of fresh air, in a partially opened or closed state rather than being completely opened, the second valve 220 needs to resist fresh air introduced thereinto. That is, to prevent the second valve 220 from yielding to pressure applied to a surface thereof by fresh air, it is necessary to provide the second valve 220 with resistance in a direction opposite to an inlet direction of fresh air.

The resistance must be provided by the motor 310. This means that an increased capacity of the motor 310 is necessary.

However, in the present invention, the second valve 220 is pivotally rotated to enter or exit an inlet direction of fresh air from the lateral side and, in other words, pivotally rotated in a direction perpendicular to or tilted relative to an inlet direction of fresh air, rather than being pivotally rotated in a direction parallel to or opposite to an inlet direction of fresh air.

Accordingly, provision of resistance for partial opening or closing of the second valve 220 (see FIG. 7) is accomplished by a coupling strength between the second valve 220 and the rotating shaft 250, and only slight load or no load is applied to the motor 310.

As described above, the guide space 130 is defined between the EGR flow channel 120 and the fresh air flow channel 110. The valve unit 200 is pivotally rotatably mounted in the guide space 130.

The guide space 130 is provided at one side thereof with a guide opening 140 to guide exhaust gas emerging from the EGR flow channel 120 so as to be introduced into the fresh air flow channel 110. The guide opening 140 enables mutual communication between the EGR flow channel 120, the guide space 130 and the fresh air flow channel 110.

The guide opening 140 takes the form of a wide incision acquired by cutting away a portion of the tubular fresh air flow channel 110.

When the second valve 220 is pivotally rotated toward the fresh air flow channel 110, the second valve 220 selectively passes through the guide opening 140 and is moved into the fresh air flow channel 110, thereby serving to interfere with a flow stream of fresh air in the fresh air flow channel 110.

The second valve 220 has a rotation path corresponding to a direction in which the rotating shaft 250 is rotated by the drive unit 300. In this case, the second valve 220 adopts sliding movement to close or open the fresh air flow channel 110.

An opening/closing direction and position of the second valve 220 do not receive resistance by a flow direction of fresh air in the fresh air flow channel 110. Therefore, there is a feature in that the motor 310 of the drive unit 300 does not need to provide the second valve 220 with very high resistance (drive force).

That is, in the case in which the second valve 220 is adapted to be closed in a direction opposite to a flow direction of fresh air, the second valve 220 needs to overcome resistance of fresh air in order to perform closing thereof. To this end, the motor 310 must have ability to prevent the second valve 220 from performing reverse motion due to the resistance of fresh air.

However, in the present invention, an opening/closing path of the second valve 220 corresponds to a direction perpendicular to a flow direction of fresh air rather than a direction opposite to a flow direction of fresh air. Therefore, there is a feature in that the motor 310 does not need to provide the second valve 220 with higher resistance (drive force) as compared to the case in which the second valve is opened or closed in a direction opposite to a flow direction of fresh air.

Figure 4:
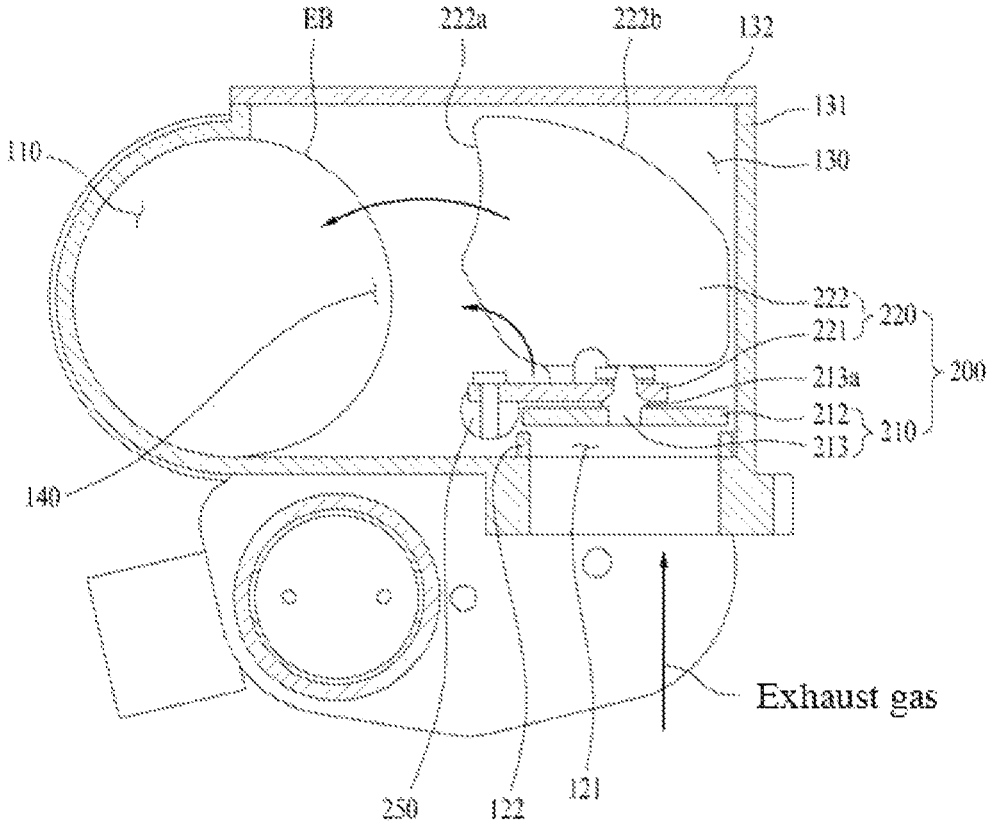
FIG. 4 is a sectional view of the EGR valve for vehicles according to the present invention.

As exemplarily shown in FIG. 4, the second valve 220 includes a connector 221 connected to the rotating shaft 250 and a plate 222 extending in a given direction from the connector 221.

Meanwhile, a peripheral surface of the plate 220 includes various shapes of curved portions. That is, the peripheral surface of the plate 222 includes a first curved portion **222*a* close to the fresh air flow channel 110 and a second curved portion 222*b* opposite to the first curved portion 222*a***.

A curvilinear contour line of the first curved portion **222*a* corresponds to an edge boundary EB of the fresh air flow channel 110**.

The edge boundary EB is a virtual line passing the guide opening 140. Since the guide opening 140 is formed by partially cutting away a circumferential portion of the fresh air flow channel 110, the edge boundary EB may correspond to the contour of the remaining circumferential portion of the fresh air flow channel 110.

When the first valve 210 is moved to some extent to slightly open the inlet port 121 of the EGR flow channel 120, the second valve 220 is moved toward the fresh air flow channel 110.

In this case, a curvilinear contour line of the first curved portion **222*a* is located at or does not overpass the edge boundary EB of the fresh air flow channel 110. This means that the first curved portion 222*a* is shaped to match the edge boundary EB of the fresh air flow channel 110 so as not to obstruct a flow stream of fresh air in the fresh air flow channel 110**.

Note that the first curved portion **222*a* may have a recessed curvilinear shape to match the edge boundary EB as described above and, alternatively, may have a convex curvilinear shape to match the shape of an inner circumferential surface of a portion of the fresh air flow channel 110** opposite to the edge boundary EB.

This shape serves to more efficiently prevent introduction of fresh air.

Alternatively, the first curved portion **222*a*** having the recessed curvilinear shape or the convex curvilinear shape may be replaced with a straight portion according to design specifications.

Meanwhile, the second curved portion **222*b* preferably has a curvilinear shape suitable to prevent the second valve 220 from interfering with an inner wall of the guide space 130** upon pivotal rotation thereof.

In the case of the curvilinear plate 222 of the second valve 220, the plate 222 may have any of various curvilinear shapes according to characteristics of lines representing flow rates of fresh air that will be described below with reference to FIG. 8.

Meanwhile, the first valve 210 includes a plate 212 connected to the connector 221 with a constant distance from the connector 221, and a connection pin 213 configured to connect the plate 212 and the connector 221 to each other while maintaining the distance therebetween.

The connection pin 213 is provided at an outer circumferential surface thereof with a spacer 213*a*. The spacer 213*a* serves to maintain the distance between the connector 221 and the plate 212.

Preferably, a valve seat 122, on which the first valve 210 is seated, is provided around the inlet port 121 of the EGR flow channel 120.

Under the above-described configuration, the fresh air flow channel 110 extends in a front-and-rear direction, the EGR flow channel 120 extends in an up-and-down direction at a position spaced apart from the fresh air flow channel 110, and the two flow channels 110 and 120 may selectively communicate with each other via the guide space 130.

Meanwhile, the guide space 130 may also serve to provide a drive space required for pivotal rotation of the valve unit 200.

The guide space 130 is defined by a sidewall 131 surrounding the circumference of the space 130 and a cover 132 placed on the sidewall 131 to cover the space.

The cover 132 is preferably separably coupled to the sidewall 131 via bolting, for example. This separable coupling is taken for inspection or replacement of the valve unit 200. However, in some situations, the cover 132 may be integrally assembled with the sidewall 131 via welding.

Hereinafter, operation of the present invention will be described with reference to the accompanying drawings.

Figure 5:
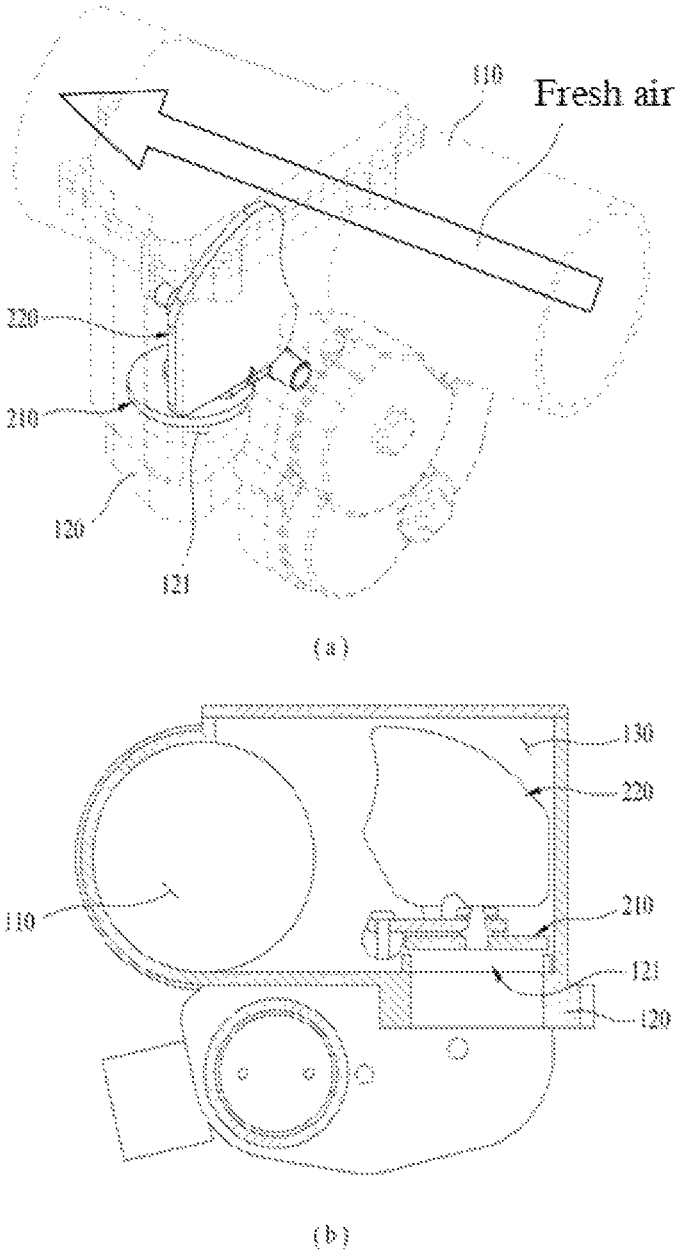
FIG. 5 is a view showing a state in which an EGR flow channel is blocked and a valve unit does not interfere with a fresh air flow channel in the EGR valve for vehicles according to the present invention.

As exemplarily shown in FIG. 5, in a state in which the first valve 210 completely blocks the inlet port 121 of the EGR flow channel 120, the second valve 220 is located in the guide space 130 and spaced apart from the fresh air flow channel 110 by a given distance.

That is, the second valve 220 is located so as not to cover a cross section of the fresh air flow channel 110 and, thus, the flow of fresh air in the fresh air flow channel 110 is not obstructed by the second valve 220.

In this case, since no exhaust gas is introduced into the fresh air flow channel 110 and the second valve 220 does not interfere with the fresh air flow channel 110, the amount of fresh air introduced through the fresh air flow channel 110 may be kept at the maximum.

Figure 6:
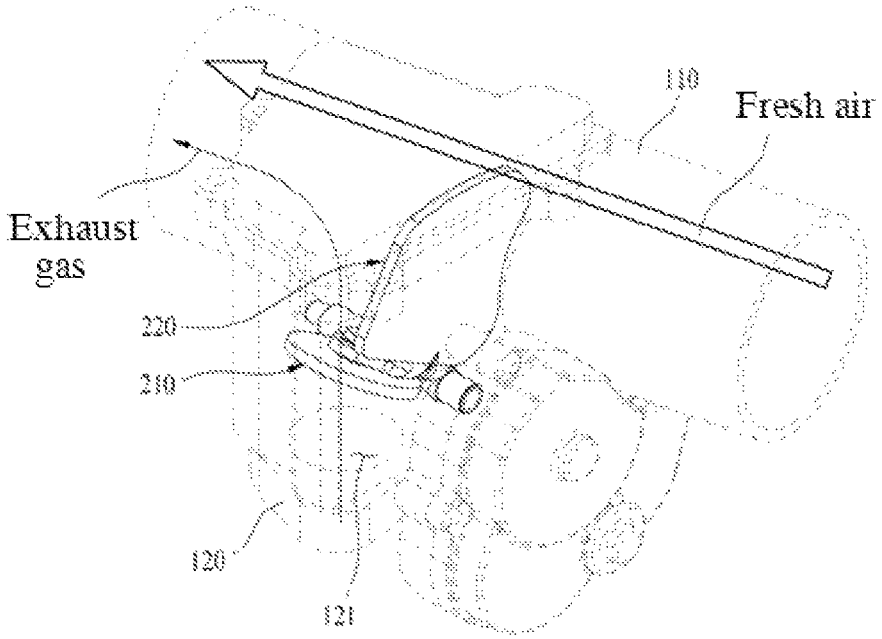
FIG. 6 is a view showing a state in which the EGR flow channel is partially opened and the valve unit does not interfere with the fresh air flow channel in the EGR valve for vehicles according to the present invention.
Figure 6:
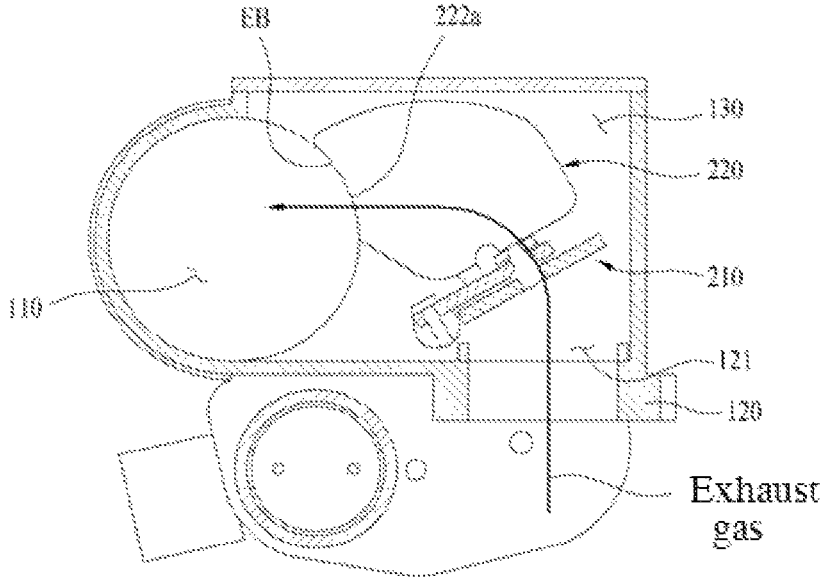

Meanwhile, as exemplarily shown in FIG. 6, when the first valve 210 is gradually opened to allow exhaust gas to be introduced into an engine, the inlet port 121 of the EGR flow channel 120 is correspondingly opened, causing exhaust gas to pass through the guide space 130 and then be introduced into the fresh air flow channel 110.

Simultaneously, the second valve 220 is pivotally rotated along with the first valve 210, thereby being moved close to the fresh air flow channel 110.

The inlet state of fresh air as exemplarily shown in FIG. 5 is kept so long as the second valve 220 does not interfere with the inner space of the fresh air flow channel 110.

That is, only addition of exhaust gas occurs in a state in which the inlet amount of fresh air is kept at the maximum. This state may be maintained until the first curved portion 222*a* of the second valve 220 and the edge boundary EB of the fresh air flow channel 110 accurately overlap each other.

The shape of the first curved portion 222*a* of the second valve 220 corresponds to the boundary of a cross section of the fresh air flow channel 110 or an outer contour line of the fresh air flow channel 110 as described above. Therefore, the second valve 220 does not interfere with a flow stream of fresh air in the fresh air flow channel 101 so long as the first curved portion 222*a* is located at the boundary or the outer contour line.

That is, the second valve 220 is still located so as not to cover a cross section of the fresh air flow channel 110 and, thus, the flow of fresh air in the fresh air flow channel 110 is not obstructed by the second valve 220.

Figure 7:
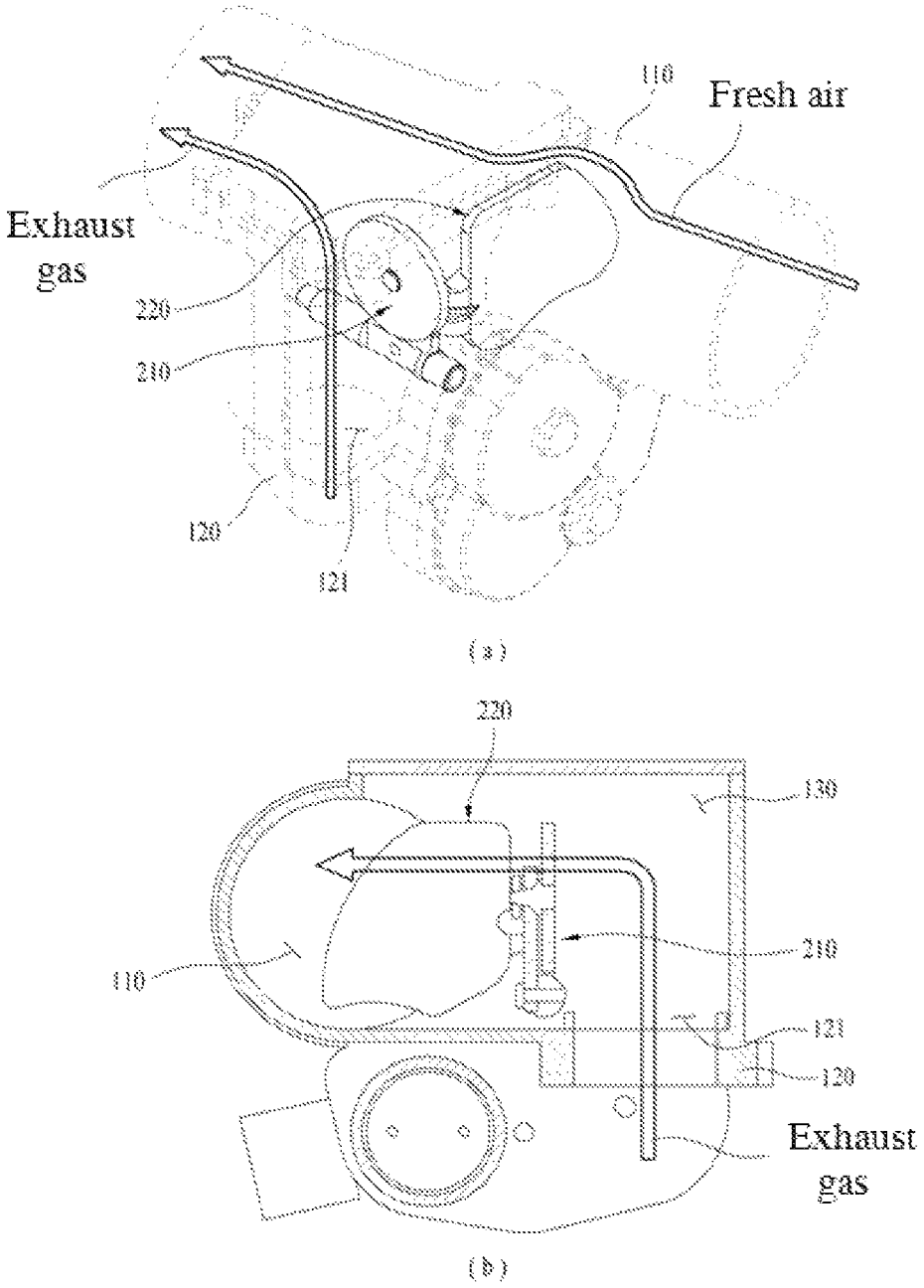
FIG. 7 is a view showing a state in which the EGR flow channel is completely opened and the valve unit interferes with the fresh air flow channel in the EGR valve for vehicles according to the present invention.

As exemplarily shown in FIG. 7, when a pivotal rotation angle of the first valve 210 is increased to achieve a greater inlet amount of exhaust gas than that in the state of FIG. 6, the first valve 210 is approximately vertically arranged as compared to a closed state thereof (the state of FIG. 5).

As such, the amount of exhaust gas having passed through the inlet port 121 of the EGR flow channel 120 becomes close to the maximum or becomes the maximum.

As an opening angle of the first valve 210 is increased, the second valve 220 is gradually moved into the fresh air flow channel 110 to cover a cross section of the fresh air flow channel 110, which causes reduction in the flow rate of fresh air passing through the fresh air flow channel 110.

When the first valve 210 is vertically arranged as exemplarily shown in FIG. 7, the inlet amount of exhaust gas may become the maximum and the amount of fresh air passing through the fresh air flow channel 110 may become the minimum.

Figure 8:
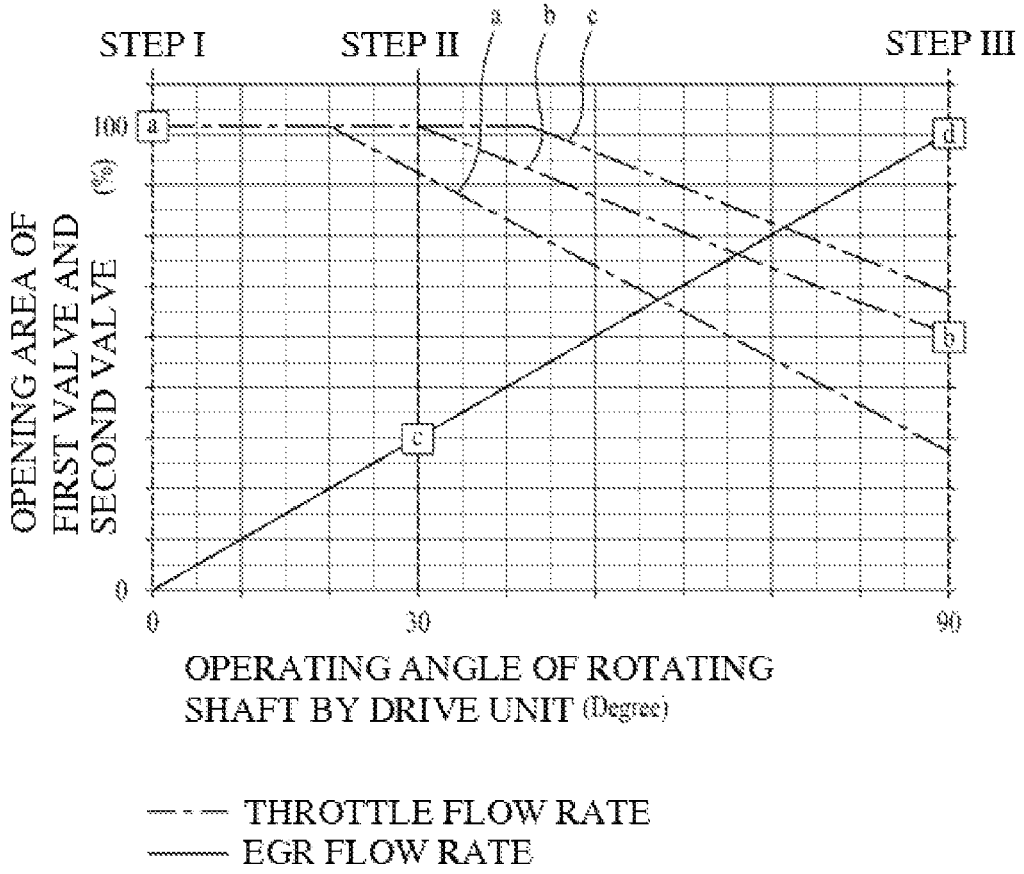
FIG. 8 is a graph showing variation in the flow rate of fresh air and the flow rate of exhaust gas to be reintroduced according to an operational state of the EGR valve for vehicles according to the present invention.

FIG. 8 is a graph showing variation in the inlet amount of fresh air and the inlet amount of exhaust gas according to the state of FIG. 7.

In FIG. 8, a throttle flow rate refers to a flow rate of fresh air and an EGR flow rate refers to a flow rate of exhaust gas introduced into the fresh air flow channel.

In FIG. 8, the X-axis represents an operating angle of the rotating shaft by the drive unit, and the Y-axis represents an opening area of the EGR flow channel by the first valve and an opening area of the fresh air flow channel by the second valve.

The operating angle of the rotating shaft by the drive unit is an angle by which the rotating shaft is operated to rotate the first valve and the second valve. It will be understood that the operating angle of the rotating shaft is the concept of input and rotation angles of the first valve and the second valve are output.

In the Y-axis, that an EGR flow rate (an opening degree of the first valve) is 100% means a completely opened state of the first valve, and that a throttle flow rate (an opening degree of the second valve) is 100% means a completely opened state of the second valve in which the second valve does not block the fresh air flow channel, thus ensuring free flow of fresh air.

In Step I of FIG. 8, the EGR flow channel is completely closed and the fresh air flow channel does not receive interference by the second valve. Therefore, the inlet amount of exhaust gas is zero and the inlet amount of fresh air is maximized. This is identical to the state of FIG. 5.

In this state, when introduction of exhaust gas is required, the first valve is pivotally rotated and gradually opened. This state corresponds to a section between Step I and Step II of FIG. 8. In this section, despite introduction of exhaust gas, the second valve still does not interfere with the fresh air flow channel and, in turn, the inlet amount of fresh air is kept at the maximum.

Step II is associated with the maximum opening angle of the first valve to guide introduction of exhaust gas while maintaining the maximally opened state of the fresh air flow channel. Although the maximum opening angle of the first valve is shown as being 30 degrees in the graph, preferably, the maximum opening angle of the first valve may vary within a range of 30 degrees±θ. This state may correspond to the state of FIG. 6.

In FIG. 8, lines a, b and c represent that a time when the second valve interferes with the fresh air flow channel, i.e. a time when the second valve covers a cross section of the fresh air flow channel may be regulated according to a rotation angle of the rotating shaft.

More specifically, line b represents that the second valve begins to interfere with the fresh air flow channel from a time when a rotation angle of the rotating shaft is 30 degrees. Line a represents that the second valve begins to interfere with the fresh air flow channel from a time when a rotation angle of the rotating shaft is 30 degrees−θ (for example, 20 degrees). Line c represents that the second valve begins to interfere with the fresh air flow channel from a time when a rotation angle of the rotating shaft is 30 degrees+θ (for example, 40 degrees).

Meanwhile, in the case in which it is necessary to increase the inlet amount of exhaust gas after Step II, a rotation angle of the rotating shaft may be increased. In this case, the second valve is moved into the fresh air flow channel, thereby serving to interfere with a flow stream of fresh air in the fresh air flow channel.

As the rotation angle of the rotating shaft is increased, the cross section of the fresh air flow channel covered by the second valve is increased, which causes sequential reduction in the inlet amount of fresh air.

Such increase or reduction in flow rate is shown in a section between Step II and Step III. A state in which the inlet amount, i.e. flow rate of exhaust gas becomes the maximum as exemplarily shown in FIG. 7 corresponds to Step III. In this state, the inlet amount, i.e. flow rate of fresh air becomes the minimum.

Figure 9:
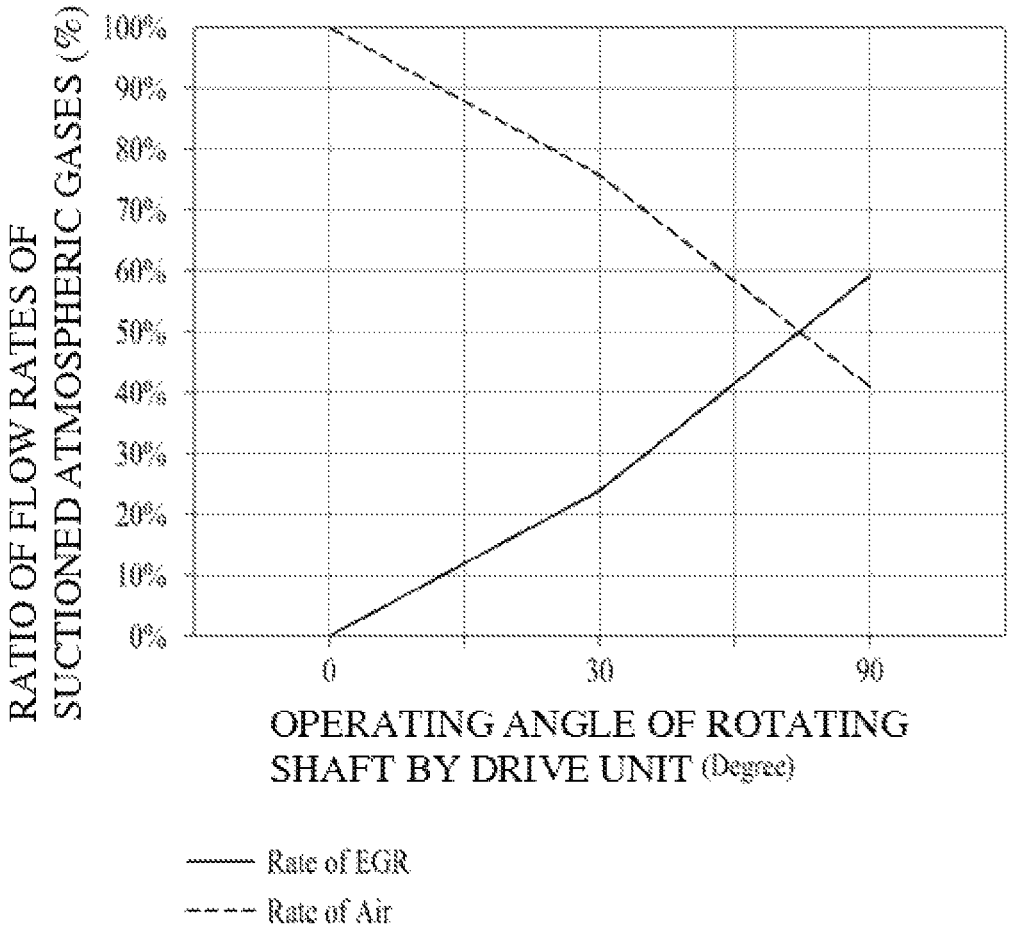
FIG. 9 is a graph showing a ratio between the inlet flow rate of fresh air and the inlet flow rate of exhaust gas according to an operational state of the EGR valve for vehicles according to the present invention.

FIG. 9 shows variation in a ratio of the flow rate of exhaust gas with respect to the entire inlet air according to an operating angle of the rotating shaft by the drive unit.

More specifically, a ratio of the flow rate of exhaust gas may be represented by a ratio of suctioned flow rate (%)=exhaust gas/(exhaust gas+fresh air)*100. In this case, as an operating angle of the rotating shaft by the drive unit is increased, the first valve is gradually opened and, in turn, the inlet amount of exhaust gas is increased.

As is apparent from the above description, according to the present invention, a valve to open or close an EGR flow channel and a valve to regulate an opening area of a fresh air flow channel are connected to each other via a single power transmission component rather than being connected by power transmission components, such as cams or gears, which may provide faster operation response.

In addition, by connecting the two valves to a single rotating shaft, it is possible to prevent one valve from malfunctioning or being inoperable during normal driving of the other valve.

Meanwhile, the two valves constitute a single module, which may contribute to easy assembly or management and reduction in price.

In addition, more easy and stable regulation to keep a balance between the flow rate of fresh air and the flow rate of exhaust air may be accomplished.

In addition, in the present invention, the valves and the rotating shaft are designed so as not to interfere with the fresh air flow channel when the fresh air flow channel is opened by 100%. Accordingly, there occurs no deterioration in the inlet pressure and amount of fresh air differently from the related art, which may result in improved fresh air suction performance.

Meanwhile, in the present invention, the second valve is operated in a direction perpendicular to or tilted relative to an inlet direction of fresh air, rather than being operated in a direction parallel to or opposite to an inlet direction of fresh air.

When it is desired to keep a conventional valve, which is pivotally rotatable in a direction parallel to or opposite to an inlet direction of fresh air, in a partially opened or closed state rather than being completely opened, the valve needs to resist fresh air introduced thereinto and, in turn, the rotating shaft connected to the valve and a drive motor to drive the rotating shaft need to resist the introduced fresh air.

On the other hand, in the present invention, since an operating direction of the second valve is not parallel to or opposite to an inlet direction of fresh air, provision of resistance to enable partial opening or closing of the second valve may be accomplished by a coupling strength between the second valve and the rotating shaft and only slight load or no load is applied to the drive motor, which may contribute to operation stability of the drive motor.

It will be apparent to those skilled in the art that the present invention may be practiced in other concrete manners without change of the technical scope or essential features of the present invention.

Hence, it should be understood that the embodiments of the present invention described above are provided for the purpose of illustration in all aspects and do not limit the present invention.

The scope of the present invention should be defined as disclosed in the accompanying claims rather than the above detailed description, and all modifications, additions and substitutions derived from the meaning and scope of the claims and equivalents thereof should be construed as being included in the scope of the present invention.

What is claimed is:

1. An exhaust gas recirculation (EGR) valve for a vehicle comprising:

a fresh air flow channel;

an EGR flow channel connected to the fresh air flow channel; and a valve unit configured to open or close the EGR flow channel and to selectively block a portion of the fresh air flow channel according to an opened or closed state of the EGR flow channel, wherein the valve unit includes:

a first valve configured to open or close the EGR flow channel; and a second valve located at one side of the first valve, the second valve being arranged at a different angle from an arrangement angle of the first valve, wherein the second valve is moved along with the first valve to selectively interfere with a flow stream of fresh air in the fresh air flow channel, wherein the first valve is arranged in a pivot valve form with respect to the EGR flow channel, wherein the second valve is arranged in a sliding valve form with respect to the fresh air flow channel, and wherein an arrangement direction of the second valve is perpendicular to or tilted relative to a flow direction of fresh air.

2. The EGR valve according to claim 1, further comprising a guide space defined between the fresh air flow channel and the EGR flow channel to guide exhaust gas emerging from the EGR flow channel to the fresh air flow channel, the guide space providing an operating space for the valve unit.

3. The EGR valve according to claim 1, wherein the valve unit further includes a rotating shaft connected to a drive unit, the drive unit being configured to provide power, wherein the first valve is connected to the rotating shaft, wherein the second valve is installed to the rotating shaft so as to be located next to the first valve, the second valve being arranged in a direction different from an arrangement direction of the first valve, and wherein the arrangement direction of the second valve is a direction perpendicular to or tilted relative to a flow direction of fresh air.

4. The EGR valve according to claim 2, further comprising a guide opening defined between the guide space and the fresh air flow channel to guide introduction of the exhaust gas into the fresh air flow channel, wherein the second valve is configured to pass through the guide opening and be moved into the fresh air flow channel when attempting to interfere with the flow stream of fresh air in the fresh air flow channel.

5. The EGR valve according to claim 1, wherein the second valve includes:

a connector connected to a rotating shaft connected to a drive unit, the drive unit being configured to provide power; and a plate connected to the connector, the plate having a prescribed area, and wherein the plate has a curved portion at a peripheral surface thereof.

6. The EGR valve according to claim 1, wherein the first valve includes:

a connector connected to a rotating shaft connected to a drive unit configured to provide power; and a plate connected to the connector, the plate having a prescribed area, and wherein the connector and the plate are connected to each other via a connection pin and spaced apart from each other by a prescribed distance.

7. The EGR valve according to claim 1, wherein, when the first valve closes the EGR flow channel, the second valve is spaced apart from the fresh air flow channel by a given distance so as not to interfere with the flow stream of fresh air in the fresh air flow channel.

8. The EGR valve according to claim 1, wherein, when the first valve reaches a first opening state thereof in which the first valve is spaced apart from an inlet port of the EGR flow channel and causes the amount of exhaust gas emerging from the EGR flow channel to be a first level, a curved portion formed at a peripheral surface of the second valve is moved so as not to overpass an edge boundary of the fresh air flow channel and, in turn, not to interfere with the flow stream of fresh air in the fresh air flow channel.

9. The EGR valve according to claim 8, wherein, when the first valve reaches a second opening state thereof in which the first valve is spaced apart from the inlet port of the EGR flow channel and causes the amount of exhaust gas emerging from the EGR flow channel to be a second level greater than the first level, the second valve is moved into the fresh air flow channel to obstruct a part of the flow stream of fresh air in the fresh air flow channel and, in turn, to interfere with the flow stream of fresh air.

10. The EGR valve according to claim 1, further comprising:

a rotating shaft connected to the valve unit to guide rotation power required to rotate the valve unit; and a drive unit connected to the rotating shaft to provide the rotation power, wherein the drive unit includes:

a motor; and a gear module connecting the motor and the rotating shaft to each other, and wherein the gear module includes:

a double-layered first gear engaged with a gear coupled to a shaft of the motor;

a double-layered second gear engaged with the first gear; and a fan-shaped third gear installed to the rotating shaft and engaged with the second gear.

11. An EGR valve for a vehicle comprising:

a fresh air flow channel for flow of fresh air;

an EGR flow channel configured to communicate with the fresh air flow channel;

a rotating shaft located at a position deviating from the fresh air flow channel; and a valve unit configured to selectively open or close the EGR flow channel by being rotated about the rotating shaft and to selectively interfere with a flow stream of fresh air in the fresh air flow channel according to an opened or closed state of the EGR flow channel so as to regulate a flow rate of fresh air, wherein the valve unit includes:

a first valve configured to open or close the EGR flow channel; and a second valve located at one side of the first valve, the second valve being arranged at a different angle form of the first valve, wherein the first valve is arranged in a pivot valve form with respect to the EGR flow channel, wherein the second valve is arranged in a sliding valve form with respect to the fresh air flow channel, and wherein an arrangement direction of the second valve is perpendicular to or tilted relative to a flow direction of fresh air.

12. An EGR valve for a vehicle comprising:

a fresh air flow channel for flow of fresh air;

an EGR flow channel configured to communicate with the fresh air flow channel;

a rotating shaft located at the outside of the fresh air flow channel, the rotating shaft being connected to a drive unit;

a first valve connected to the rotating shaft to selectively open or close the EGR flow channel; and a second valve connected to the rotating shaft so as to be moved simultaneously with the first valve upon rotation of the rotating shaft, the second valve being arranged to selectively cover a cross section of the fresh air flow channel, wherein the first valve is arranged in a pivot valve form with respect to the EGR flow channel, wherein the second valve is arranged in a sliding valve form with respect to the fresh sir flow channel, and wherein an arrangement direction of the second valve is perpendicular to or tilted relative to a flow direction of fresh air.

13. The EGR valve according to claim 12, further comprising:

a guide space defined between the fresh air flow channel and the EGR flow channel; and a guide opening formed by partially cutting away a circumferential portion of the fresh air flow channel, the guide opening defining one side of the guide space to guide exhaust gas emerging from the EGR flow channel to the fresh air flow channel, wherein the second valve passes through the guide opening to block the fresh air flow channel so as to regulate the inlet amount of fresh air passing through the fresh air flow channel.

14. The EGR valve according to claim 12, wherein the second valve includes:

a connector connected to the rotating shaft; and a plate connected to the connector, the plate having a prescribed area, and wherein the plate has a curved portion at a peripheral surface thereof.

15. The EGR valve according to claim 12, wherein the first valve includes:

a connector connected to the rotating shaft connected to the drive unit, the drive unit being configured to provide power; and a plate connected to the connector, the plate having a prescribed area.

16. The EGR valve according to claim 12, wherein, when the first valve closes the EGR flow channel, the second valve is spaced apart from the fresh air flow channel by a given distance so as not to cover a cross section of the fresh air flow channel.

17. The EGR valve according to claim 12, wherein, when the first valve reaches a first opening state thereof in which the first valve is spaced apart from an inlet port of the EGR flow channel and causes the amount of exhaust gas emerging from the EGR flow channel to be a first level, a curved portion formed at a peripheral surface of the second valve is moved so as not to overpass an edge boundary of the fresh air flow channel and, in turn, not to cover the cross section of the fresh air flow channel.

18. The EGR valve according to claim 17, wherein, when the first valve reaches a second opening state thereof in which the first valve is spaced apart from the inlet port of the EGR flow channel and causes the amount of exhaust gas emerging from the EGR flow channel to be a second level greater than the first level, the second valve is located to obstruct a part of the flow stream of fresh air in the fresh air flow channel by covering the cross section of the fresh air flow channel and, in turn, to interfere with the flow stream of fresh air.

* * * * *